United States Patent [19]

LaFleur

[11] Patent Number: 4,781,473

[45] Date of Patent: Nov. 1, 1988

[54] LARGE BAG WITH LIFT STRAPS

[75] Inventor: Arnie LaFleur, Manistee, Mich.

[73] Assignee: Custom Packaging Systems, Inc., Manistee, Mich.

[21] Appl. No.: 120,123

[22] Filed: Nov. 12, 1987

[51] Int. Cl.[4] ..... B65D 33/06

[52] U.S. Cl. ..... 383/16; 383/17; 383/24

[58] Field of Search ..... 383/16, 17, 21, 24

[56] References Cited

U.S. PATENT DOCUMENTS

| | | | |
|---|---|---|---|
| 4,207,937 | 6/1980 | Sandeman et al. | 383/17 |
| 4,301,848 | 11/1981 | Beaven et al. | 383/24 |
| 4,524,457 | 6/1985 | Marino | 383/17 |

FOREIGN PATENT DOCUMENTS

| | | | |
|---|---|---|---|
| 2081213 | 2/1982 | United Kingdom | 383/17 |

*Primary Examiner*—Willis Little

*Attorney, Agent, or Firm*—Barnes, Kisselle, Raisch, Choate, Whittemore & Hulbert

[57] ABSTRACT

A large bulk container is provided with a lift strap formed from a strip of flexible material for lifting the bulk container. The bulk container has connecting side panels and either a closed or open top and preferably a generally rectangular shape when filled. The strip forms a loop above the panels and has two ends connected in overlapping relationshp to adjacent side panels. A diagonal line of connection is provided between the two sides of the strap forming the loop and above the side panels to orient the lifting forces generally into one plane and in a generally vertical direction. The lift strap thereby prevents separation from the connected side panels and the spilling of the container contents upon lifting by the strap.

15 Claims, 1 Drawing Sheet

FIG. 1
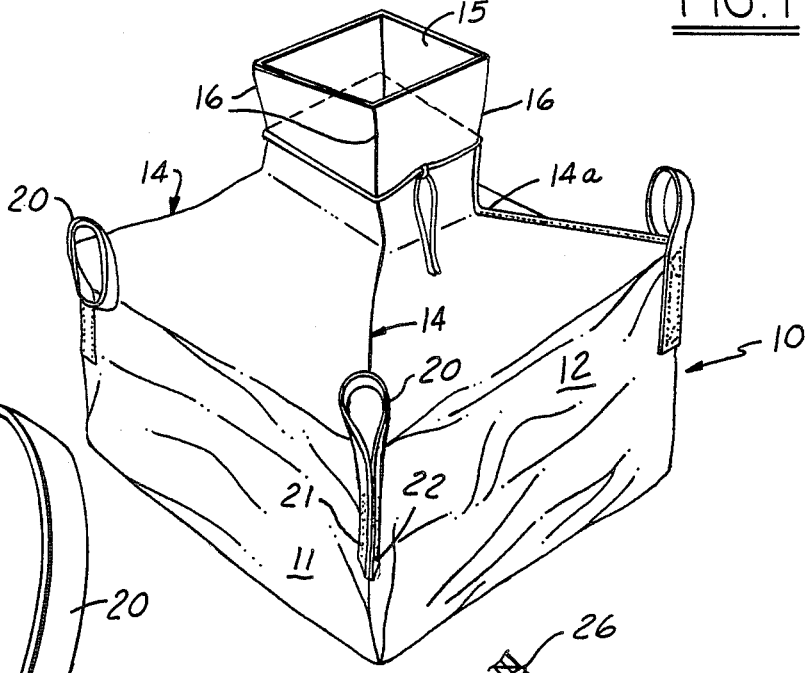
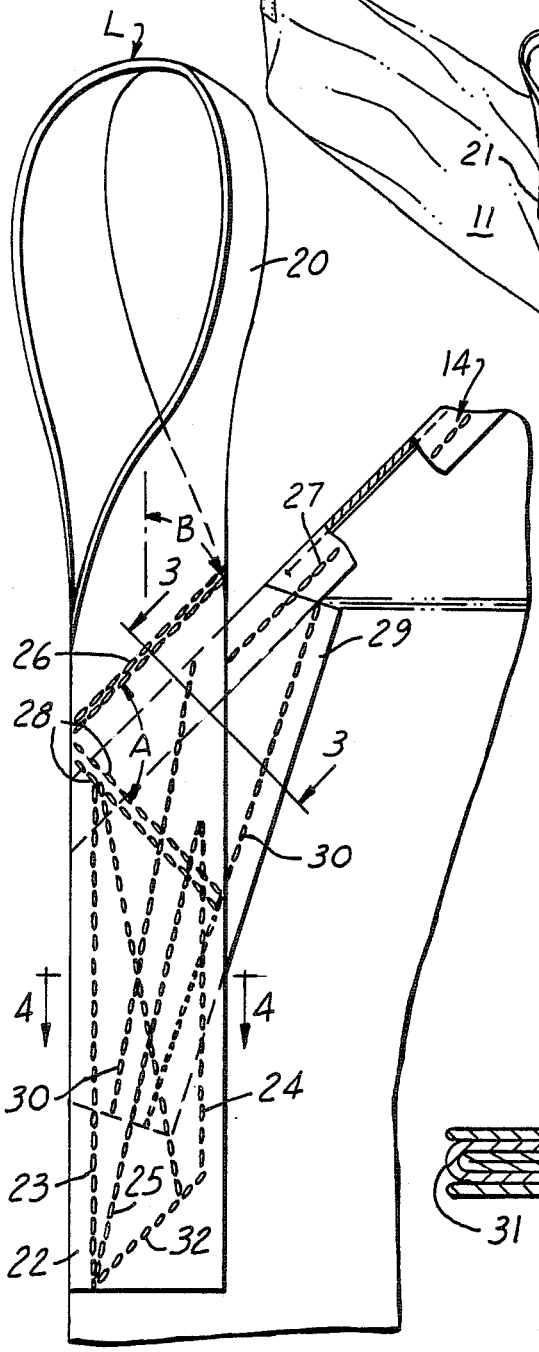
FIG. 2
FIG. 3
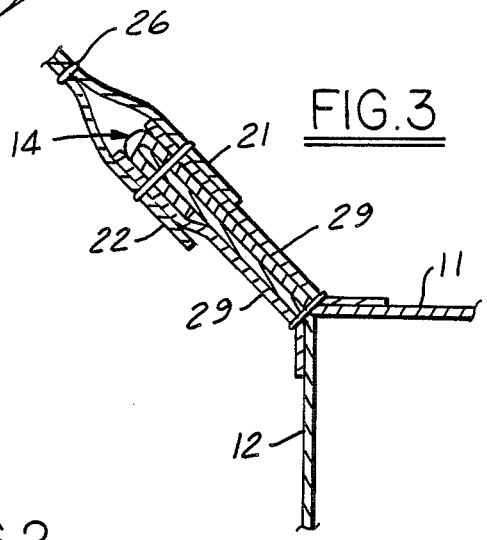
FIG. 4
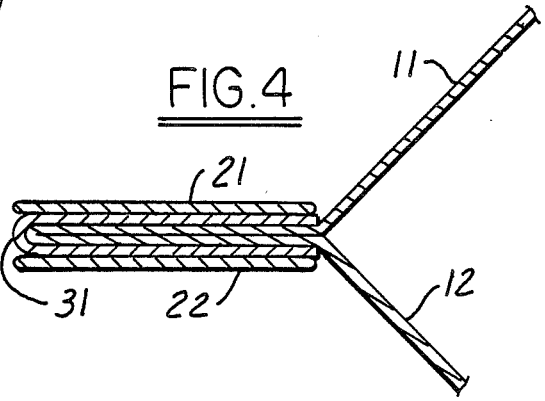

LARGE BAG WITH LIFT STRAPS

This invention relates to a shipping and storage container and, more specifically, to a large bulk, collapsible container in the form of a bag made of a woven fabric, and particularly to such a bag having a provision so that it can be lifted as by the tines of a lift truck.

BACKGROUND AND SUMMARY OF THE INVENTION

Many products, such as granular and liquid materials, are shipped and stored in large bulk bags adapted to hold as much as a ton or more of material. The use of bags for this purpose has become popular recently because the bags can be shipped from the manufacturer to the material shipper in a folded and generally flat condition and, if properly designed, when empty can be returned by the user to the shipper in the same generally flat condition for reuse.

A fabric bag used in the above manner has to fulfill several practical requirements. It is of primary importance that the construction of the bag be such as to sustain relatively heavy loads. At the same time, it is essential that the bag is adapted to be folded or collapsed to a compact flat form. Frequently, because of the nature and quantity of material shipped in such bags, the bags should also be designed so that they can be easily filled and emptied of their contents. It is also desired that such bags be designed so that, when filled, they are free standing and capable of being stacked vertically one upon another. Furthermore, depending upon the type of material being shipped, some bags are also required to be moisture-proof or water resistant.

A particularly satisfactory bag is shown in U.S. Pat. No. 4,596,040.

Such bags should preferably also have some sort of attachment thereon which enables them to be lifted by the tines of a forklift truck. In the aforementioned patent, provision is made in the bag construction for receipt of the tines of a lift truck. It has also been suggested that straps be connected to the bag wherein each strap is arranged to form a loop above a corner to receive the tines of a forklift truck utilized to lift the container. However, when the load is heavy, lifting the bag by the straps, often causes tearing or separation of the connected panels of the container destroying the bag and resulting in loss of its contents.

Among the objectives of the present invention are to provide a bag having lift straps such that the bag can be easily lifted without separation of the associated connecting panels, without causing damage to or destruction of the bag, and without loss of its contents, which is adapted to be engaged with the tine of a forklift truck or other similar means for lifting the filled bag, which is rugged, durable, and is of relatively simple design and economical manufacture and assembly.

In accordance with this invention, a large bulk container is provided with a lift strap formed from a strip of flexible material. The bulk container has connecting side panels and either a closed or open top and preferably a generally rectangular shape when filled. The two ends of the strip of flexible material are secured in overlapping relationship to adjacent side panels to form a loop above the panels, and have at least one diagonal line of connection between the two sides of the strap and above the panels arranged to orient the lifting forces on the container generally into one plane and in a generally vertical direction. The lift strap thereby prevents the separation of the connected side panels and the spilling of the container contents upon lifting by the strap. Preferably, the lift strap is also fixed to the bulk container by an additional diagonal line of connection extending generally transversely to the first diagonal line which also tend to orient the lifting forces to prevent separation of the side panels.

DESCRIPTION OF THE DRAWINGS

FIG. 1 is a fragmentary perspective view of a bulk bag embodying this invention.

FIG. 2 is a fragmentary part sectional view on an enlarged scale of a portion of the bag.

FIG. 3 is a sectional view taken along the line 3—3 in FIG. 2.

FIG. 4 is a sectional end view taken along the line 4—4 in FIG. 2.

DESCRIPTION

In the preferred method of use, the lift strap construction embodying the invention is utilized for lifting a collapsible bulk container or bag 10 as disclosed in U.S. Pat. No. 4,596,040 herein incorporated by reference. The bag 10 includes, when collapsed, a flat tubular blank of flexible material comprising a pair of flat overlying panels adapted to form a pair of opposite side walls 11 of the container and a pair of folded gusseted panels extending inwardly between the flat overlying panels 11 from the opposite side edges of the overlying panels and adapted to form two other opposite side walls 12 of the container. To provide a generally rectangular top and bottom when unfolded, adjacent each end of the blank, each flat panel 11 and adjacent gusseted panel 12 are connected together along lines 14 extending diagonally inward from the opposite side edges of the panels 11, 12 towards the end of the tubular blank.

To form an opening in the top, the diagonal lines 14 of connection terminate at their laterally inner ends in spaced apart relationship laterally outwardly of the inner fold edges of the gusset panels at points **14*a* spaced from one end of the blank. To form a spout 15, each flat panel 11 and adjacent gusset panel 12 are connected together along a line 16 extending lengthwise of the blank from the points of termination of the diagonal lines 14 to the one end of the blank and each panel 11, 12 is severed along a line spaced laterally outwardly of, parallel to and generally co-extensive in length with the lengthwise line of connection 16. If desired, a second spout is similarly fashioned at the other end of the bag. If only one spout is desired, the other end of the bag is completely closed by extending the diagonal lines of connection 14** to the end of the blank.

As illustrated in FIGS. 2 and 3, a lift strap 20 is formed from a single piece of flexible material having two ends 21, 22, each being fixed to and overlapping two adjacent connected panels 11, 12 at the corners of the generally rectangularly shaped container, thus forming a loop L above the panels. The strap ends 21, 22 are fixed to their associated panels 11, 12 by preferably at least two spaced apart lines of connection 23, 24, preferably stitching, preferably extending nearly the entire length of each overlapped end. These strap ends 21, 22 are also fixed to the associated panels by at least one and preferably two diagonal lines of connection 25, preferably stitching, extending generally from opposite ends of the parallel lines 23, 24 of connection. A diagonal line or lines of connection 26, preferably stitching, connects overlapping portions of the strap 20 forming the loop L and generally traversely of each strap at a location above the connected adjacent panels 11, 12. The line or lines of connection 26 preferably extend generally parallel to the diagonal line of connection 14 forming a portion of the top of the container when folded flat.

A diagonal second line or lines of connection 28, preferably stitching, is provided beneath line 26 and generally transversely of the straps and forms an included angle A with line 26 which is in the range of about 65° to 115°, usually 75° to 105°, desirably 80° to 110°, and preferably about 90°. The diagonal line of connection 26 forms an acute included angle B with the longitudinal axis of the strap in the range of about 25° to 65°, typically 35° to 55° and preferably about 45°. Preferably, to insure any liner in the bag does not hang up and tear on the stitching securing the strap, a line of connection 32, preferably stitching, extends diagonally across the lower end of the strap and preferably slopes upwardly generally parallel to the lines of connection 26.

Preferably, reinforcement panels 29 overlap a portion of an associated flat panel 11 and gusset panel 12 and preferably extend through their diagonal line of connection 14. The reinforcement panels 29 are connected to the panels 11, 12 along lines of connection 30 which are preferably stitching. Preferably, the reinforcement panels 29 are formed from a single piece of flexible material such as woven fabric or plastic film with an interconnecting bight 31 and each having a V like shape. Preferably, the reinforcement panels underlie a portion of the overlapped ends 21, 22 of the strap, overlap a portion of the connected panels 11, 12 forming a side wall corner of the bag, and also overlap a portion of each of the associated flat panel and gusset panel forming a portion of the top of the bag along their diagonal line of connection 14. Alternatively, the reinforcement panels may overlap both the strap ends and both connected panels.

In practice, each loop L is adapted to receive a tine of a forklift truck. Since the tine of the forklift truck has a substantial width, it forces the sides of the strap forming the loop L to form an acute angle with respect to the direction of vertical lifting force of the tine, thus imparting both a vertical and horizontal component of the lifting force onto the strap which tends to separate its ends from the bag. The line of diagonal connection 26 between both sides of the strap forming the loop resists the horizontal component of the lifting force so that both strap ends lie generally in one plane and in a generally vertical direction, due to the angle and location of line 26, so that the lifting force acts generally vertically on the connected side panels 11, 12.

In practice, the tine is also usually laterally offset or misaligned with the underlying side of the bag which creates a force tending to separate and tear the ends 21, 22 from the panels 11 and 12 along the lines of connection 23, 24 and 25. This force is also created if the bag is lifted by only one or two straps. This separation and tearing is prevented by the second diagonal line or lines of connection 28. The diagonal lines 28 prevent sufficient force from being exerted on the lines of connection 23, 24, 25 to cause the panels 11, 12 to tear or separate along these lines. In addition, lines 28 reinforce the connection between the strap ends 21, 22 and the associated panels 11, 12.

Usually, each bag has at least two and preferably four lift straps L. However, it has been found that a bulk bag containing one ton of material and having a lift strap L embodying this invention, can be picked up and carried by a single tine of a forklift truck inserted in only one such lift strap without any damage to the bag or the strap and without losing its contents. In contrast, a bulk bag filled with one ton of material and having prior art lift straps must be picked up and carried by at least two lift straps to avoid damage to the bag and straps and loss of its contents.

It can thus be seen that there has been provided a lift strap which is suitable for lifting a variety of large bulk bags; which prevents the separation of associated connected adjacent panels and the destruction of the bag and loss of its contents; which is rugged, durable, of relatively simple design, and can be economically manufactured and assembled.

I claim:

1. A large bulk bag comprising:

a container having a flexible sidewall, a strap of flexible material having opposed ends, means fastening said ends in overlapping relation to adjacent overlapped sidewall portions of the container and forming a loop with a pair of runs extending above said sidewalls; and a line of connection of said runs extending diagonally across said runs, located beyond said side wall portions and constructed and arranged to orient the lifting forces generally into a plane of the overlapped ends of said strap such that the separation of said strap from said connected adjacent sidewall portions is prevented upon lifting of the container by said strap.

2. The bulk bag set forth in claim 1 wherein said strap is a woven fabric.

3. The bulk bag set forth in claim 1 including a reinforcement panel interposed between each end of the strap and the adjacent side wall portions.

4. The bulk bag set forth in claim 1 wherein said line of connection is inclined to the longitude of the strap at an acute included angle in the range of about 25° to 65°.

5. The bulk bag set forth in claim 4 wherein said line of connection comprises stitching.

6. The bulk bag set forth in claim 4 which also comprises a second line of connection between both runs of the strap and its associated side wall portions, and at an included angle to such first line of connection in the range of about 65° to 115°.

7. The bulk bag set forth in claim 6 wherein said second line of connection comprises stitching.

8. The bulk bag set forth in claim 1 wherein said means fastening said ends comprises at least two spaced apart generally parallel and longitudinally extending lines of connection fixing each overlapping end of said strap to its associated side wall portions.

9. The bulk bag set forth in claim 8 wherein said last-mentioned lines of connection comprise stitching.

10. The bulk bag set forth in claim 8 wherein said means fastening said ends also comprises at least one diagonal line of connection extending generally from opposite ends of said generally parallel lines of connection.

11. The bulk bag set forth in claim 10 wherein said last-mentioned diagonal line of connection comprises stitching.

12. The bulk bag set forth in claim 1 which also comprises another line of connection between said runs and associated side wall portions lying adjacent the ends of said runs and extending generally parallel to said first-mentioned connection of said runs.

13. The bulk bag set forth in claim 12 wherein said another line of connection comprises stitching.

14. The bulk bag set forth in claim 6 which also comprises another line of connection between said runs and associated side wall portions lying adjacent the ends of said runs and extending generally parallel to said first-mentioned connection of said runs.

15. A large bulk bag comprising:

a container having a flexible sidewall, a strap of flexible material having opposed ends, means fastening said ends in overlapped relation to adjacent sidewall portions of the container and forming a loop with a pair of runs extending above said side walls; and a line of connection of said runs extending diagonally across said runs, located beyond said sidewall portions, not connected with said sidewall portions, and constructed and arranged to orient the lifting forces such that the separation of said strip from said connected adjacent sidewall portions is prevented upon lifting of the container by said strap.

* * * * *